US005196708A

United States Patent [19]

Mullock

[11] Patent Number: 5,196,708

[45] Date of Patent: Mar. 23, 1993

[54] PARTICLE SOURCE

[75] Inventor: Stephen J. Mullock, Cambridge, England

[73] Assignee: Kratos Analytical Limited, Urmston, England

[21] Appl. No.: 838,364

[22] Filed: Feb. 19, 1992

[30] Foreign Application Priority Data

Feb. 20, 1991 [GB] United Kingdom ..... 9103535

[51] Int. Cl.[5] ..... H01J 3/40

[52] U.S. Cl. ..... 250/423 R; 250/424; 250/286

[58] Field of Search ..... 250/423 R, 424, 286

[56] References Cited

U.S. PATENT DOCUMENTS 3,096,437 7/1963 Muray ..... 250/286

4,904,872 2/1990 Grix et al. ..... 250/423 R

FOREIGN PATENT DOCUMENTS 2209242 4/1989 United Kingdom .

*Primary Examiner*—Jack I. Berman

*Attorney, Agent, or Firm*—Leydig, Voit & Mayer

[57] ABSTRACT

An ion source for producing a series of bursts of ions of predetermined energy suitable for use in a time-of-flight mass spectrometer is described. The source includes an ion gun 1 whose accelerating voltage is periodically varied such that the energy of the ions produced by the gun 1 is ramped from a first energy to a second energy. A chopping means is provided to chop the beam of ions produced by the gun 1 at, times corresponding to periods during which the energy of the particles is being ramped.

9 Claims, 2 Drawing Sheets

PARTICLE SOURCE

BACKGROUND OF THE INVENTION

1. Field of the Invention

This invention relates to particle sources. In particular the invention relates to particle sources for producing short bursts of particles.

Such sources are used, for example, in a time-of-flight mass spectrometer to produce bursts of charged or neutral particles which in turn are directed onto a sample so as to excite bursts of ions from the sample, the bursts being of typically one to one hundred nanoseconds duration. The times for the bursts of ions from the sample to travel a certain distance are measured. As these times are dependent on the masses of the ions in the sample, the spectrum of the masses can be determined from the measured times of travel.

The accuracy of the flight time measurement, and hence the mass measurement, is improved if the initial pulse of secondary ions is made shorter in duration. Specifically the uncertainty in flight time measurement is always greater or equal to the duration of the primary excitation ion pulse at the sample surface.

For the charged particle source to produce the necessary short bursts of charged particles, the source is gated, that is it is switched on and off very quickly. The ratio of on-time divided by off-time of the particle source is referred to as the duty cycle of the source, and is typically less than one in one thousand when the source is used in a time of flight mass spectrometer. The average particle current is equal to the current produced by the source when switched on, multiplied by the duty cycle, and normally this average current limits the rate at which useful data can be collected from the spectrometer. The duty cycle at the sample cannot be increased without a loss in the relative accuracy of the time measurement, so it is therefore desirable to start with a relatively long burst from the ion source and bunch it in such a way that the number of particles in the burst remains constant, but the duration of the burst as it hits the sample surface is much shorter.

If one considers a pulse of particles all travelling at the same velocity, but spread out in space, in order to bunch the particles and thus cause all the particles to hit the sample within a very short duration, it is necessary to impose a small velocity spread in the particles in such a manner as to cause particles at the tail of the pulse to catch up with those at the front of the pulse during the time taken for the pulse to travel to the sample.

2. Description of the Prior Art

One conventional ion source will now be described with reference to FIG. 1, which is a schematic diagram of an ion source buncher for the ion source, and a sample.

Referring to the figure, an ion gun 1 is arranged to provide a continuous constant particle beam with energy provided by the high voltage supply 2 of, for example, 25 kilo electron volts. From this beam a primary pulse 3, may be chopped by causing the beam to be scanned across an aperture 4, by means of deflection plates 5, commonly referred to as blanking plates. It will be appreciated, however, that other arrangements can give the same result, for example an electrostatic sector energy filter using pulsed excitations as used by Benninghoven.

Bunching of the ions in the pulses 3 is produced by a buncher 6. This consists of a parallel plate capacitor 7,8, with a hole 9 through the centre through which ions may pass. An instantaneous voltage edge 10 is applied to either plate of the capacitor 7,8, whilst the primary pulse 3 is between the plates 7,8, in such a way as to accelerate the ions in the direction of the sample 11. For example if the ions are positive ions, a positive voltage edge, indicated as 10, could be applied to the plate 7. As ions at the tail end of the pulse will receive a greater energy impulse than those at the leading edge of the pulse, there will be a first order correction in the time taken for the ions to travel to the sample, and thus a bunching effect of the ions within each pulse will occur. The energy dispersion required, and hence the magnitude of the voltages required to be applied to the plates 7,8, depends on the distance $l_s$ from the plates 7,8 to the sample 11 and the initial energy $V_o$ of the primary pulses.

The voltage edge $V_b$ required to be applied to the plate 7 may be expressed by:

$$V_b = 2V_o\, l_b/l_s$$

where $l_b$ is the distance between the plates 7,8 in the buncher 6.

For the example of pulses of Gallium ions of $V_o = 25$ kV starting energy and 20 nanoseconds duration, the primary pulses will be 5.4 mm in length. If the distance $l_s$ from the plates 7,8 to the sample 11 is 80 mm, the energy spread required is 3.4 kV. Thus if the distance $l_b$ between the plates 7,8 is chosen to be 8 mm so as to comfortably accommodate each unbunched primary pulse, this will necessitate a 5 kV voltage edge with a rise time of about 2 nanoseconds.

While such an arrangement is relatively satisfactory, the charged particle source suffers the disadvantages that it is necessary to incorporate and align extra hardware constituting the buncher 6. Furthermore, it is difficult to arrange for $l_s$ to be very large so as to reduce the necessary bunching voltage $V_b$, as the blanking plates and aperture 4,5 as well as ion optics (not shown) must be arranged between the source and the buncher 6. Also if the ion beam is to be focussed, placing the source further from the sample 11 will result in a poorer focal spot. Furthermore, the slew rate of the power supply (not shown) for the buncher 6 has to be extremely fast as the full voltage has to be reached whilst each ion pulse 3 is contained between the plates 7,8 and the timing of the edge 10 is critical to the region of nanoseconds. Whilst suitable pulsed power supplies do exist, they are very expensive and have repetition rate and lifetime limitations.

In order to reduce the necessary voltage edge $V_b$, it is possible to form the buncher 9 of a number of stages, each of the capacitor form described above. Whilst this has the advantage that the magnitude of the voltage edge $V_b$ required is reduced proportionately by the number of stages, the arrangement has the disadvantages that extra hardware is required in the ion source, that is one plate for each stage, these plates being difficult to align. Furthermore the slew rate of the power supply required is still very high.

SUMMARY OF THE INVENTION

It is an object of the present invention to provide a charged particle source which enables bunching of the charged particles, but wherein the above disadvantages are greatly reduced.

According to a first aspect of the present invention, a particle source for producing a series of bursts of particles of predetermined energy comprises: means for producing a beam of charged particles, means for varying the accelerating voltage within the means for producing the charged particles such that the energy of the charged particles is periodically ramped from a first energy to a second energy, and chopping means for chopping the beam to produce pulses of charged particles from the beam at times corresponding to the periods during which the energy of the charged particles is ramped.

If necessary, where the source includes a charged particle lens arrangement, the source may further include means for varying the voltage to the charged particle lens arrangement in accordance with the variation in the accelerating voltage so as to reduce chromatic aberrations in the lens arrangement.

According to a second aspect of the present invention, a method of using a particle source so as to produce a series of bursts of particles of predetermined energy comprises: varying the accelerating voltage within a means for producing a beam of charged particles such that the energy of the charged particles is periodically ramped from a first energy to a second energy, and chopping the beam to produce pulses of charged particles from the beam at times corresponding to the periods during which the energy of the charged particles is ramped.

BRIEF DESCRIPTION OF THE DRAWINGS

One embodiment of a particle source, in accordance with the invention will now be described with reference to the accompanying Figures, in which.

DESCRIPTION OF THE PREFERRED EMBODIMENT

Figure 1:
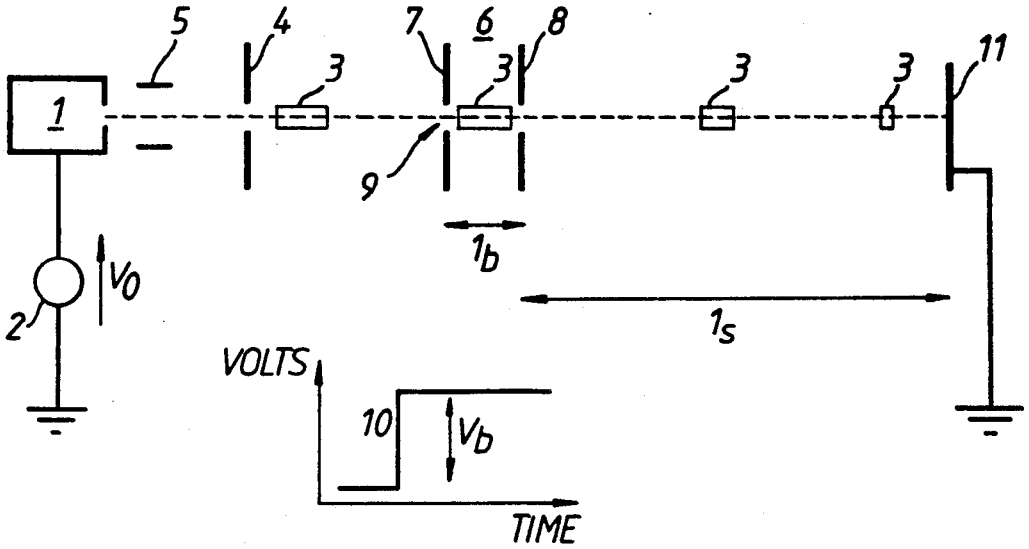
Fig.1. PRIOR ART
FIG. 1 is a schematic diagram of the prior art ion source as has already been described.
Figure 3:
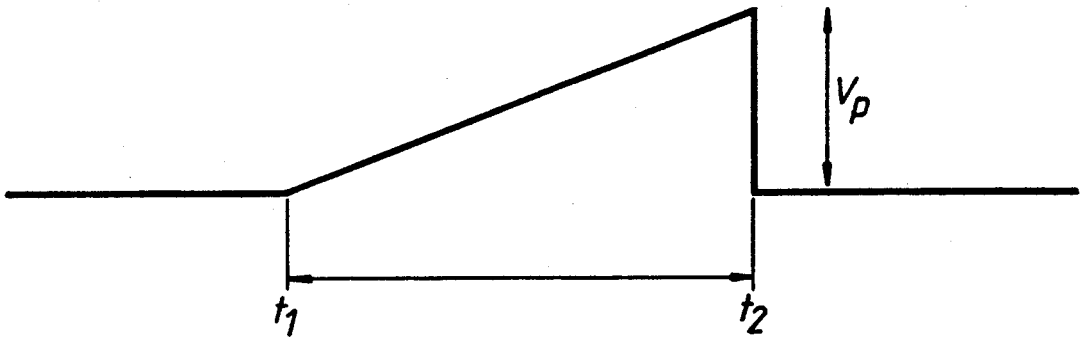
FIG. 3 illustrates the varying accelerating voltage used in the ion source of FIG. 2.
Figure 2:
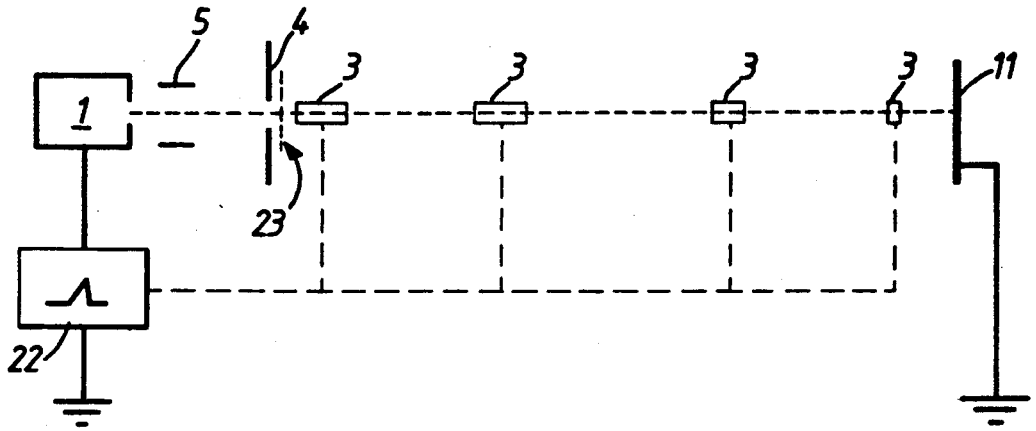
FIG. 2 is a schematic diagram of an ion source in accordance with the invention.

Referring to FIGS. 2 and 3 together, the embodiment of the source in accordance with the invention is an ion source which is a modification of the prior art ion source described herebefore, and thus corresponding components to those of FIG. 1 are correspondingly labelled. In the embodiment of the ion source shown in FIG. 2, the high voltage supply 2 is replaced by a high voltage ramp generator 22 arranged to apply a periodic voltage ramp of the form shown in FIG. 3 to the accelerating voltage of the gun 1, this voltage ramp being superimposed on the normal d.c. accelerating voltage of the gun.

Thus in the source shown in FIG. 2, ions emitted up to the time $t_1$ will have an energy corresponding to the normal d.c. accelerating energy, for example 25 kV in the case of the Gallium ions described in relation to FIG. 1. Ions emitted during the time period $t_1$ to $t_2$ however, will have a steadily increasing energy up to a maximum $V_o+V_p$. The ions at the tail of the pulse will therefore tend to catch up the ions at the front of the pulse during the ions' flight to the sample 11.

If a chopping stage, shown in FIGS. 1 and 2 as deflection plates 5 and aperture 4, is placed close to the gun 1 as in a conventional source, then a relatively long section of the beam can be chopped out between the time period $t_1$ and $t_2$, before the bulk of the bunching has taken place. The source thus performs a bunching operation without the necessity for the buncher 6, as shown in FIG. 1. As the origin of the energy dispersion is as far from the sample 11 as it possibly can be, the dispersion energy $V_p$, which will correspond to the voltage $V_b$ in the prior art arrangement, may be reduced. It will be seen that no extra hardware other than a ramp generator is required in the charged particle source as the energy dispersion results from the voltages applied to existing apparatus: thus existing sources may readily be adapted.

Because the energy dispersion results from the voltage ramp shape instead of from the position of ions within the primary pulses 3 between the two plates 7,8 shown in FIG. 1, the rise time $t_2 t_1$ of the voltage $V_p$ may be an order of magnitude greater than the time over which the voltage $V_b$ must be applied to the buncher 6 of FIG. 1, in which the ramp time is determined by the speed of the passage of the ions between the two plates, this voltage pulse being much easier to produce than in the prior art arrangement. The timing jitter between the voltage edge $V_p$ and the arrangement for chopping pulses from the continuous beam produced by the gun 1 is also less critical by an order of magnitude.

Assuming that the distance between the gun 1 and the sample 11 is double that of the distance $l_s$ between the buncher 6 and the sample 11 of the prior art ion source shown in FIG. 1, this being a very conservative assumption, a voltage edge 2.5 kV high over 30 nanoseconds will be required. A pulse generator capable of producing such voltage pulses is readily available.

In some charged particle sources in accordance with the invention, probe forming charged particle lenses may suffer due to chromatic aberrations caused by the energy dispersion produced in the beam produced by the ion gun 1. This will cause the spatial resolution of a mass spectrometer employing the charged particle source to suffer. This may, however, be compensated for by applying the ramp voltage $V_p$, suitably delayed, to the lenses.

It will be appreciated that whilst the particle source in accordance with an embodiment of the invention described herebefore is an ion source, the invention is also applicable to electron sources. Furthermore, when a charge exchange cell, indicated schematically as 23 in FIG. 2, is inserted after the chopping stage 4 and 5, a pulse compressed neutral beam may be produced.

Figure 4:
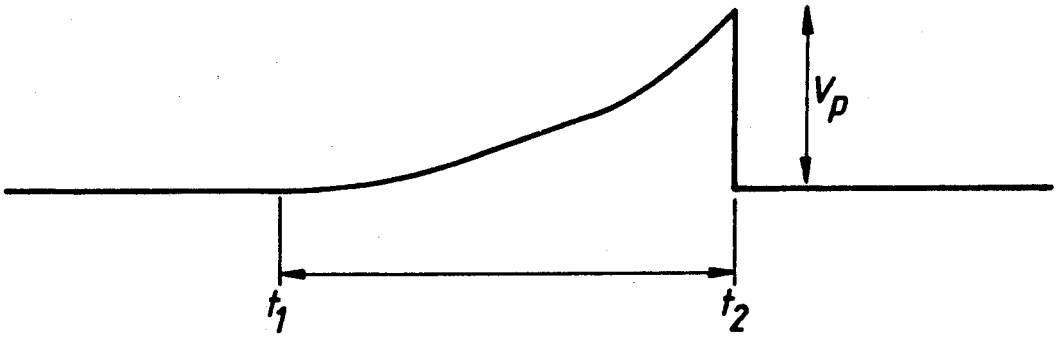
FIG. 4 illustrates an alternative varying accelerating voltage used in the ion source of FIG. 2.

It will be appreciated that whilst in the particular source, in accordance with the embodiment of the invention described herebefore, a linear voltage ramp as shown in FIG. 3 is used so as to make a first order correction to the particle flight time, the voltage ramp used may be non-linear, for example as shown in FIG. 4. Such a non-linear voltage ramp may be tailored to produce further order corrections to the particle flight time.

It will also be appreciated that whilst a particle source in accordance with the invention has particular application in a time of flight mass spectrometer, sources and methods in accordance with the invention will find application in other situations where energetic ions or atoms are used for excitation of a target, and time resolution of the measured response is required.

What I claim is:

1. A particle source for producing a series of bursts of particles of predetermined energy comprising: means for producing a beam of charged particles, means for varying the accelerating voltage within the means for producing the charged particles such that the energy of the charged particles is periodically ramped from a first energy to a second energy, and chopping means for chopping the beam to produce pulses of charged particles from the beam at times corresponding to the periods during which the energy of the charged particles is ramped.

2. A particle source according to claim 1 including a charged particle lens arrangement, and means for varying the voltage to the charged particle lens arrangement in accordance with the variation in the accelerating voltage so as to reduce chromatic aberrations in the lens arrangement.

3. A particle source according to claim 1 in which the charged particles are electrons.

4. A particle source according to claim 1 in which the charged particles are ions.

5. A particle source according to claim 1, including a neutralisation stage effective to neutralise the charged particles after they have been chopped by the chopping means.

6. A particle source according to claim 1 in which the means for varying the accelerating voltage applies a periodic linear ramp to the energy of the charged particles.

7. A particle source according to claim 1 in which the means for varying the accelerating voltage applies a periodic nonlinear ramp to the energy of the charged particles.

8. A method of using a particle source so as to produce a series of bursts of particles of predetermined energy comprising: varying the accelerating voltage within a means for producing a beam of charged particles such that the energy of the charged particles is periodically ramped from a first energy to a second energy, and chopping the beam to produce pulses of charged particles from the beam at times corresponding to the periods during which the energy of the charged particles is ramped.

9. A method of using a particle source according to claim 8 in which the source includes a charged particle lens arrangement, and the voltage to the charged particle lens arrangement is varied in accordance with the variation in the accelerating voltage so as to reduce chromatic aberrations in the lens arrangement.

* * * * *